US006705485B1

(12) United States Patent
Sato et al.

(10) Patent No.: US 6,705,485 B1
(45) Date of Patent: Mar. 16, 2004

(54) DRINKING LEARNING CUP

(75) Inventors: Ryotaro Sato, Tokyo (JP); Emi Kuramoto, Tokyo (JP); Hitoshi Takagi, Tokyo (JP)

(73) Assignee: Pigeon Corporation, Tokyo (JP)

( * ) Notice: Subject to any disclaimer, the term of this patent is extended or adjusted under 35 U.S.C. 154(b) by 0 days.

(21) Appl. No.: 09/720,124

(22) PCT Filed: Mar. 29, 2000

(86) PCT No.: PCT/JP00/01963

§ 371 (c)(1),
(2), (4) Date: Feb. 12, 2001

(87) PCT Pub. No.: WO00/64315

PCT Pub. Date: Nov. 2, 2000

(30) Foreign Application Priority Data

Apr. 23, 1999 (JP) ..... 11-117017

(51) Int. Cl.[7] ..... B65D 25/48
(52) U.S. Cl. ..... 220/713; 220/717; 220/731
(58) Field of Search ..... 220/731, 717, 220/703, 705, 711, 716, 718, 713; 215/387; 222/566, 567

(56) References Cited

U.S. PATENT DOCUMENTS 1,191,464 A * 7/1916 Record ..... 222/108
2,317,046 A * 4/1943 Fleming ..... 220/717
2,608,841 A * 9/1952 Rice ..... 215/309
4,146,157 A * 3/1979 Dixon et al. ..... 222/424
4,190,173 A * 2/1980 Mason et al. ..... 220/203
4,235,348 A * 11/1980 Watson ..... 220/703
4,243,156 A * 1/1981 Lobbestael ..... 222/541.6
4,388,996 A * 6/1983 Panicci ..... 220/603
4,986,437 A * 1/1991 Farmer ..... 220/713
5,050,759 A * 9/1991 Marble ..... 220/705
5,147,066 A * 9/1992 Snider ..... 220/717
5,203,467 A * 4/1993 Tucker ..... 220/717
5,398,843 A * 3/1995 Warden et al. ..... 220/713
5,538,157 A * 7/1996 Proshan ..... 220/717
5,645,191 A * 7/1997 Neville ..... 220/717
5,823,384 A * 10/1998 Sartori de Zamparolo .. 220/717

FOREIGN PATENT DOCUMENTS

GB 2172793 A * 10/1986

* cited by examiner

*Primary Examiner*—Joseph Man-Fu Moy
(74) *Attorney, Agent, or Firm*—Westerman, Hattori, Daniels & Adrian, LLP

(57) ABSTRACT

The drinking cup for learning which can train babies in the drinking movement step-by-step in order to provide a baby, who is at the age of taking milk and taking the liquid food, the lessons of the technique for taking either liquids or the liquid food naturally without spilling them. The drinking cup for learning includes a main container 12 for containing liquid, the main container having at least a cup-shaped opening 12*a* and a drinking spout member 11 removably attached to the main container. The drinking spout member 11 includes an opening communicating with the main container and a top-opened guide means 14 provided with barrier portions 15 forming at least both side edges.

3 Claims, 11 Drawing Sheets

(a) (b)

DRINKING LEARNING CUP

TECHNICAL FIELD

This invention is relates to a drinking cup for learning, used to train babies to take liquid beverages or liquid foods.

TECHNICAL BACKGROUND

Babies take liquid foods like milk by suckling, but as babies mature it becomes necessary to train them to take liquids, such as water or juice, from a cup with a large mouth rather than from a feeding bottle with an artificial nipple.

Conventionally, a caregiver, such as the mother, will scoop up liquid in a small spoon and give it to the baby, training the baby to drink. This is not the same as drinking from a cup and cannot train the baby to drink liquid contents directly from a container.

However, even if one tried to give babies liquid directly from a container such as a cup, they are unable to take liquid without dribbling it as adults do, because their mouths and lips are not yet developed.

In other words, babies are unable to make the movements of drinking continuously by taking a certain amount of liquid into their mouth from a cup and appropriate learning tools are required in order to train babies for such drinking action. The learning tools needed in order to carry out appropriate training in drinking movement for babies, helping them to perceive liquid coming from a container through the baby's lips, have not yet been developed.

In other words, in regard to such training, it is necessary for liquid to be introduced, in a naturally appropriate flow, into babies' mouths. At this time, we need a tool that can be used to train babies to detect with their lips the amount of liquid. Also, it is desirable to train babies to drink directly from a container with a wide mouth, such as a cup, to complete the training. A drinking cup for learning that is structured for step-by-step training, in response to these requirements, is not known.

This invention was made to solve such problems and has as its purpose the provision of a drinking cup for learning through step-by-step training, so that babies between the stages of taking only milk and taking natural foods may acquire the technique of taking liquid or liquid foods naturally, without dribbling.

DISCLOSURE OF THE INVENTION

The purpose described above, in regard to this invention, would be achieved by a drinking cup for learning, including:

- a main container for containing liquid, the main container having at least a cup-shaped opening; and
- a drinking spout member removably attached to the main container, wherein the drinking spout member includes an opening communicating with the main container and a top-opened guide means provided with barrier portions forming at least both side edges According to the aforementioned structure, the liquid food contained in the main container having a cup-shaped opening would come out from the main container. When the drinking spout member is fitted to the main container, one is able to introduce an appropriate amount of liquid food to the baby's mouth via the opening of the drinking spout member.

By tilting the main container, the liquid food would be led to the guide means from the opening of the drinking spout member, and the liquid food would not drip because of the barrier portions forming both side edges. At this time, the baby is able to touch the liquid food with his/her upper lip since the top of the guide means is open. In this way, it is possible to train babies to perceive the flow of liquid food through the feeling of their upper lips.

Also, when, through this training, the baby has become able to perceive the flow of liquid through his/her upper lip to some degree, training can be shifted towards taking liquid from an ordinary cup by removing the drinking spout member and having the baby's mouth on the cup-shaped opening of the main container. In regard to this, liquid food includes a wide range of liquid foods such as liquid beverages and soups which babies are able to take.

THE BEST MODE FOR IMPLEMENTING THE INVENTION

The best mode for implementing the present invention will be explained in detail with reference to the figures attached as follows:

Further, since the embodiment stated below is the suitable practical example of embodiment for this invention and various limitations as technically appropriate can be added, the scope of this invention shall not be limited by these patterns unless mention is made specifically of something that limits this invention in regard to the explanation below.

Figure 1:
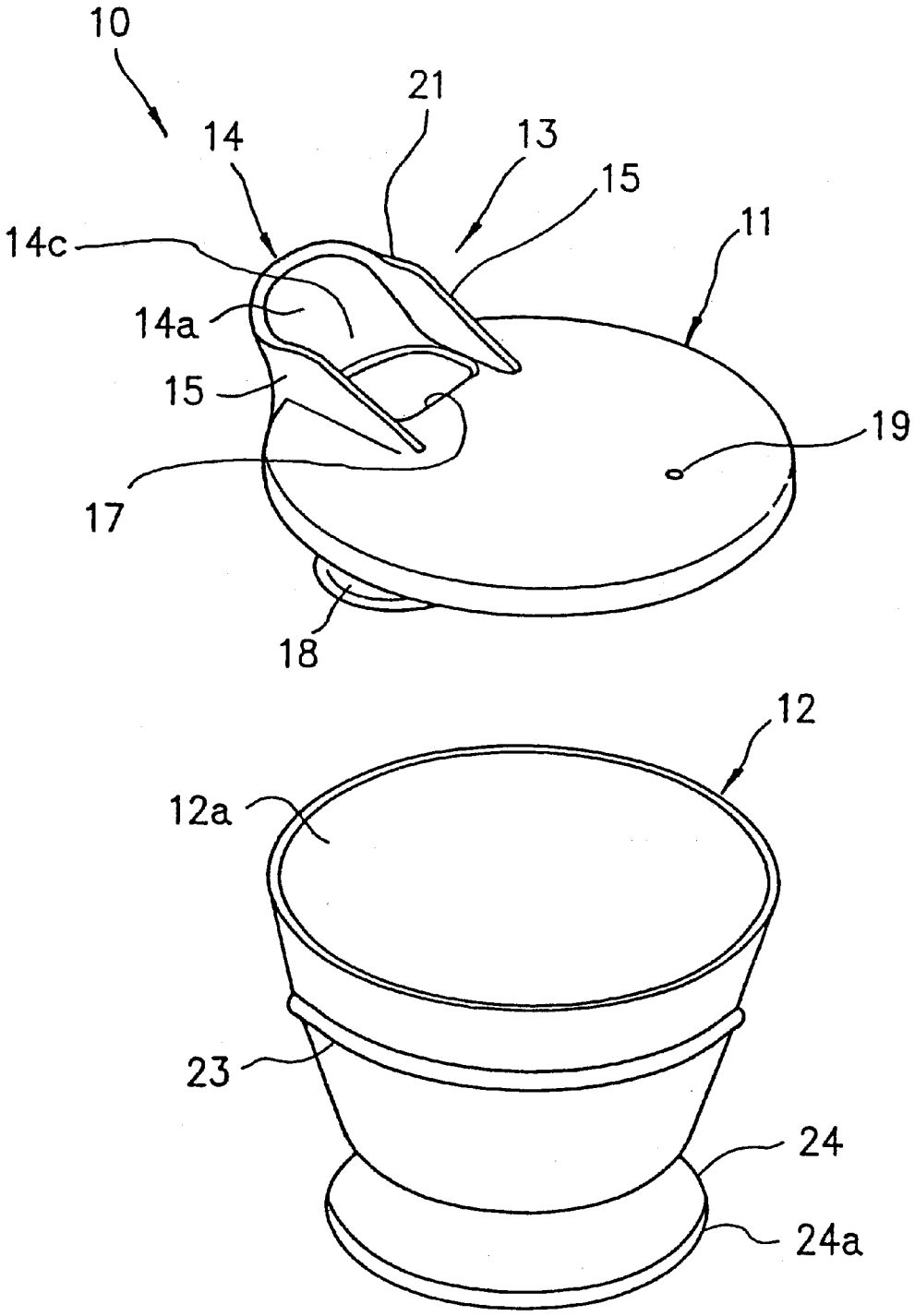
FIG. 1 is a schematic perspective view of an embodiment showing the drinking cup for learning according to the present invention.

FIG. 1 is a schematic perspective view showing the first embodiment of the drinking cup for learning according to the present invention. In this figure, the drinking cup for learning 10 is equipped with a main container 12 and a drinking spout member 11 which can be fitted to and removed from the main container.

The main container 12 is composed of polypropylene, for example, a composite synthetic resin material having thermal stability. This main container 12, for example, is formed in a semi-sphere shape in whole, and is equipped with the opening 12*a* which is a wide mouth toward the upper direction. The main container 12 is best formed with transparent or semi-transparent material, so that it is possible to easily observe the conditions and remaining portions of liquid food contained. This main container 12 is not limited to the form indicated in the figure, but a deeper form or shallower form can be applied to it.

Especially in this embodiment, the main container 12 is structured to gradually become wider towards the top. This shape is used so that, as explained later, when the caregiver gives the liquid food to the baby, tilting the main container 12, as the content is decreased the amount of tilt required becomes smaller, so that the baby's feeding posture will not change.

The opening 12*a* of the main container 12 is given a shape equivalent or similar to an ordinary drinking cup, as stated later, so that in the later stages of the baby training the baby is able to drink by touching his/her mouth directly on the opening 12*a*.

Also, there is a protrusion 23 which is formed around the outside of the main container 12, preventing slipping when the main container 12 is held by hand and also becoming a grip for the fingers when removing drinking spout.

Furthermore, there is a leg part 24 formed on the lower part of main container 12, and there is a anti-slip device 24*a* made of rubber, for example, formed at the bottom of leg section 24.

Figure 2:
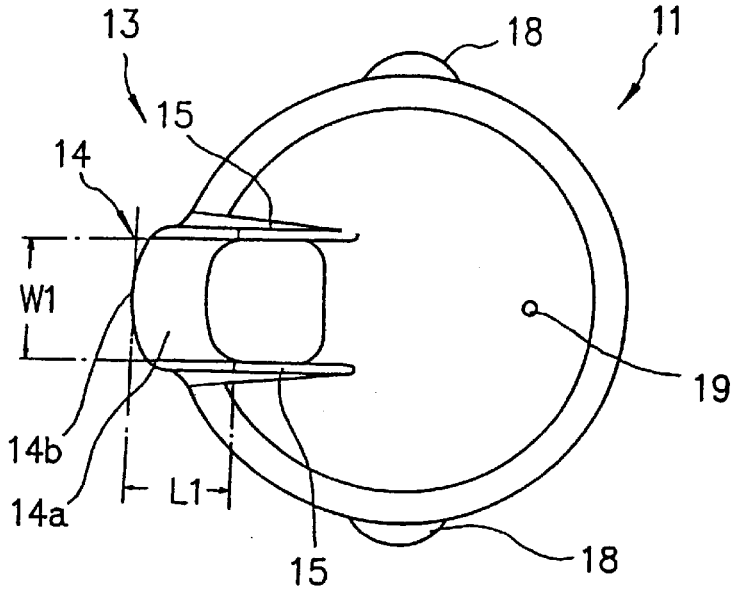
FIG. 2 is a plan view of the spout part of the drinking cup for learning shown FIG. 1.

The drinking spout member 11 is formed as shown in FIG. 1, for example, and the plan view of the part of drinking spout 11 is indicated in FIG. 2. Also, FIG. 3 is a schematic vertical section with the drinking spout member 11 fitted to the main container 12.

This drinking spout member 11, as described later, is used in the beginning stage of the training when babies try to take the liquid food from a container for the first time without using a feeding bottle. At this stage, the spout is fitted to the main container 12.

The drinking spout member 11 is best made using a synthetic resin which has some level of flexibility, for example being formed by an elastomer of hardness 85, in order to make easier its fitting to and removal from the main container 12 and also to reduce the feeling of strangeness when babies touch their mouths to it.

Figure 3:
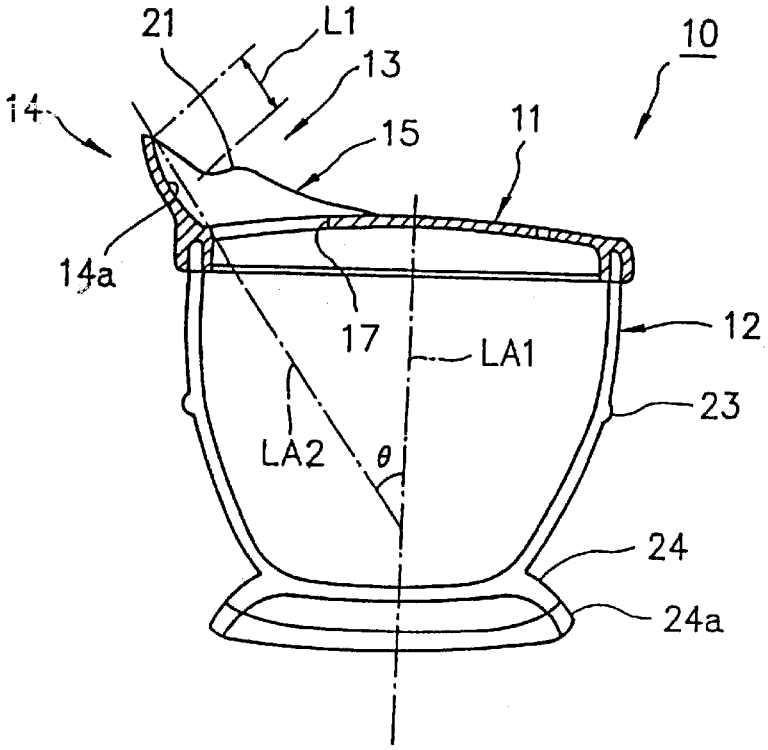
FIG. 3 is a schematic horizontal cross-sectional view showing the drinking cup for learning shown in FIG. 1.

This drinking spout member 11, as shown in FIG. 3, is formed in a flat round shape in whole in order to fit into the open mouth of the main container 12, and is formed with hand-grip tabs 18 and 18 on the sides in order to ease fitting and removal.

Also, the opening 17 is formed near the opening of the drinking spout member 11, and since the opening 17 penetrates to the drinking spout member 11, the liquid food contained in the main container will pass through.

Also, a small through hole 19 is formed in the drinking spout member 11 and becomes a vent.

Further, a drinking spout (a drinking spout member main body) 13 is formed in the opening 17. The drinking spout member 13 is formed by barrier portions 15 which stand up along both sides of the opening 17 and are formed as a single unit continuously from the side part of the opening 17, and this spout 13 is equipped with guide means 14 with a steep face 14*a* which is gradually increased toward the upper side.

The barrier part 15 above has a function to form the liquid path, along with the steep face 14*a*, so that the liquid food which comes through the opening 17 does not leak or drip. In this way, in the case of this embodiment, the barrier part 15 is composed of a wall which stands up in each unit on two sides of the opening 17 of the drinking spout member 11, and the upper part of the guide means 14 is open becoming the open part 14*c*.

This drinking spout 13, as indicated in FIG. 3, when the drinking spout member 11 is fitted to the main container 12, as described later, the liquid food (can not be indicated in figure) contained in the main container 12 will pass through the opening 17 of the drinking spout member 11 and will be introduced into baby's mouth by the caregiver by inclining the main container 12 when the drinking spout 13 is put into the baby's mouth (can not be indicated in figure).

Therefore, any pattern of the guide means 14 is fine if it is able to lead the liquid food (can not be indicated in figure) into baby's mouth through the opening 17 of the drinking spout member 11. In an extreme case, it is fine that the steep side 14*a* stands up without inclining it, for example, and the flow amount of the liquid food that passes through the opening 17 can be adjusted beforehand.

However, for the following reasons an inclined face formed by the lower side of the guide means 14, as described above, is desirable.

In other words, considering the inclined face 14*a* of the guide means 14 above the drinking spout 13, as indicated in FIG. 3, the theoretical line LA2 running along the upper side of this inclined face 14*a* is inclined degree ? against the theoretical line LA1, which runs in the middle of vertical direction of the liquid drinking cup 10. This degree ? is established preferably in a range between 30 degrees and 45 degrees, while in the example given it is 33.6 degrees.

The reasons for determining the degree ? of the inclined face 14*a*, as described later, is because if the incline angle becomes smaller than 30 degrees the baby cannot feed since the baby would have to bend forward, and if the inclination becomes greater than 45 degrees the baby cannot be positioned for proper posture because the baby would have to lean back.

Further, in regard to the degree θ of the inclined face 14*a*, it is preferable that one be able to adjust the incline angle within the range described above, which allows the caregiver to select the most suitable degree while feeding the liquid food.

Further, the inclined face 14*a* of the drinking spout 13 is equipped with the following structures.

Figure 4:
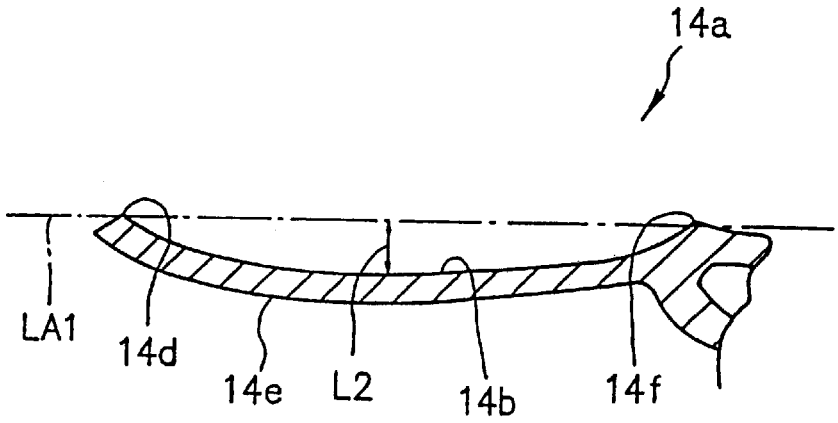
FIG. 4 is an enlarged end view showing the structure of inclined surface of the drinking spout member of the drinking cup for learning shown in FIG. 1.

FIG. 4 is an end view showing the above theoretical line LA2 horizontally and is expanded in order to indicate the structure of the inclined face 14*a* more specifically.

In this figure, the inclined face 14*a* is able to hold a small amount of the liquid food and is designed to hold the volume equivalent to a single portion equivalent to a baby's feeding movement as described later.

Specifically, the inclined face 14*a* is equipped with a concave part 14*b;* the end part of the main container side 14*f,* and the end part of the front-end side 14*d* are higher. In this way, the entire unit is formed like a bowl or a cup, and its capacity is no more than 3 cc and is established in a range of 0.8 cc and 2.3 cc. In this example, the capacity is 1.5 cc.

It has been confirmed through experimentation that if the capacity of the incline face 14*a,* the bowl part, exceeds 2.3 cc, the baby tends to vomit it because that volume is too much to be fed at one time. Also, if the capacity is less than 0.8 cc, it is not enough for practicing the drinking of liquid. Its capacity was established in the wide range described above because capacity will differ slightly as affected by the liquid surface tension characteristics even though an appropriate capacity with the bowl full to the brim is desired.

Also, the suitable depth for L2 of the concave part 14*b* described above is between 3 mm and 7 mm. The depth for this example was established at 5 mm.

The depth L2 of the concave part 14*b* was determined in relation to the baby's movement when drinking the liquid. When the liquid food is placed on the inclined face 14*a,* baby's lower lip touches the bottom face of the drinking spout 13, and at the same time, as described later, the baby's upper lip can touch the liquid face through the open part 14*c* as well, but the depth should be so that the upper lip does not touch the bottom surface directly.

If the depth of L2 of the concave part 14*b* is less than 3 mm, the baby's lower lip would touch the bottom face of the drinking spout 13 and the baby's upper lip would directly touch the bottom face of the bowl part, and it would not be possible to train the baby to drink while adjusting the flow amount into his/her mouth with the movement of baby's mouth, based on the feeling of his/her upper lip in the drinking movement. If the depth of L2 of the concave part 14b is greater than 1 mm, the capacity amount described above would be exceeded and the amount to suck in would be too much since the depth is too great. Also, since baby does not have much strength to close his mouth, the baby would become unable to touch the upper lip to the liquid face appropriately when the lower lip touched the bottom face of the drinking spout 13, if the depth is too great.

Also, the front edge 14*b* of the guide means 14 becomes the rounded part which is curved in almost uniformly to the rounded part of the main container 12.

In this way, babies can experience the feeling of the state wherein the rounded part of an ordinary drinking container, like a cup, is touched to the baby's mouth, with the front edge side of the guide means 14 in the baby's mouth, achieving an important part of the training for taking liquid food. Therefore, the curvature of the front edge 14*b* of the guide means 14 is not limited to the curve ratio of the rounded part of the main container 12, but it is fine if the curve corresponds to an ordinary drinking container.

Furthermore, the drinking spout member 11 is explained in FIG. 2; the left side is the front, and the right side is the back.

Further, the width W1 of the guide means 14, described above, of the drinking spout 13 shown in FIG. 2 is determined as follows: the width of a baby's mouth (contact between upper lip and lower lip) during the period moving from taking milk and taking liquid food (ages roughly five months to nine months) is 25 mm to 32 mm. Babies can open their mouths slightly larger than these widths, but during these months, the babies cannot close their upper and lower lips tightly together. Babies also have not obtained the complete capability to move their lips or purse their lips while adjusting their mouths to the shape of the guide means 14.

A width of about 25 mm to 40 mm is appropriate for the width W1 of the guide means 14 based on the characteristics of mouths of babies during the period of taking liquid food, and it is preferably established with the width of about 25 mm to 35 mm. The width in this example is 29 mm.

If the width of W1 of the guide means 14 is narrower than 26 mm, it becomes easy liquid to dribble out of the baby's mouth since a gap is created when the baby closes his/her upper and lower lips. In other words, it is necessary to establish the width of W1 of the guide means 14 wide enough to fit the mouth completely and not to let the liquid leak out of the mouth.

On the other hand, if the width of W1 of the guide means 14 is wider than 40 mm, it is impossible for the baby to locate the upper lip in an appropriate position in contact with the liquid surface when the lower lip touches the lower face of the bowl part corresponding to the inclined face 14*a*.

Also, the area of the opening 17 was established to be able to provide the appropriate amount when the liquid food is given to babies. In this example, the area is approximately 20 mm×23 mm.

The front tip side of the guide means 14 described above, as shown in FIG. 2, protrudes beyond the round side of the drinking spout member 11. In this way, and with the width W1 determined as above, the baby is able to catch the liquid into the mouth easily.

Also, the front tip side of the barrier part 15 described above, as indicated in FIG. 1 and FIG. 3, gradually inclined and have a step part, and location of the peak of the step part comprises a locator part 21.

This locator part 21, is used for instance, when the mother or other caregiver inserts the guide means 14 of the drinking cup for learning 10 into baby's mouth, and is the method used to determine the position of the spout and not to put it unnecessarily deeply into the baby's mouth. Therefore, the locator step 21 requires a means of recognizing the position at least by observing from the outside. This locator step 21 is composed as the step part in this embodiment described above.

In this way, when the guide means 14 enters the baby's mouth, the step part 21 as this locator part locates the position that corresponds to the front tip of the baby's upper lip. The distance L1, from the front tip 14*b* of the guide means 14 to the locator part 21, corresponds to the length of the guide means 14 that is inserted into baby's mouth at that time. Consequently, the step part 21 also achieves the function of preventing the spilling of liquid off the edge of baby's mouth by bridging the gap at both sides of the baby's mouth.

Here it has been confirmed by research conducted by the inventors that the positioning of the front tip 14*b* of the guide means 14 must be determined so that it does not reach further into the mouth than the position of the two canine teeth on the baby's lower jaw.

If the front tip of the guide means 14 is inserted more deeply than the position described above, baby tends to bite on it before the caregiver or mother pulls out the guide means 14. Then, the liquid food, which is led through the guide means 14, flows into the back of the baby's mouth. In this way, the baby would close his/her lips and would be unable to learn the mouth movement of catching the liquid and carrying it into the mouth. Also, if the distance L1 described above is too short, the baby tends to move the face forward since baby recognizes that the liquid food is not entering the mouth completely and the posture of taking food becomes unnatural.

To confirm the length from the front tip of the lips to the position where it connects with the two canine teeth of the lower jaw, based on research as described above, the average length is about 15 mm. Through this research, it was confirmed that an appropriate length for distance L1, described above, is about 10 mm to 20 mm, and a distance of 12 mm to 18 mm was more appropriate. In the case of this example, the distance is about 15 mm.

The drinking cup for learning 10 of this embodiment, is composed as described above and it is used as follows:

First, we will explain the first step in beginning the training of a baby for the taking of liquid foods which are contained in a container rather than a feeding bottle, in another words, without suckling.

The person who gives the food to baby, for example the mother, will put the liquid food (not drawn) that is to be given to the baby, into the main container 12 of the drinking cup for learning 10 through its opening 12*a,* and will fit the drinking spout member 11 to it as indicated in FIG. 3.

At this time, since the drinking spout member 11 is composed of flexible material and is also equipped with handgrip tabs 18, the action of fitting to and removing from the main container 12 is easy.

Next, the mother will insert the guide means 14 of the drinking spout 13 of the drinking cup for learning 10 into the baby's mouth. At this time, the mother will lightly touch the locator step 21 of the guide means 14 to the front tip of the baby's upper lip. In this way, the position of the guide means 14 in the mouth can be determined in regard to the amount of insertion. In other words, so the mother can observe the locator part 21 simply by looking down at the baby, the locator part 21 is formed in the upper face of the drinking spout member 11. The mother also can control the amount inserted into the mouth very easily, since the locator part 21 has the step part and the mother can gently feel that the locator part 21 is directly touching the front tip of the baby's upper lip.

Once inserted, the mother will incline the main container 12 forward to a degree where the inclining face of the guide means 14 becomes almost horizontal, as described in FIG. 3.

In this way, the liquid food (not drawn) contents in the main container 12 will reach to the inclining face 14*a* through the opening 17 of the drinking spout member 11. At this time, as indicated in FIG. 4, the liquid food will pass over the edge part 14*f,* which is higher, and will enter the concave part 14*b* and will be held there temporarily.

In other words, the liquid food will pass through the flow path that was created by the barrier portions 15 and the guide means 14, and will be held in the bowl shaped concave part 14*b*.

And, as described above, the guide means 14 will be located in the lips rather than the position that connects with the canine teeth of the lower jaw. In this position, the baby will touch his/her lower lip to position 14*e* in FIG. 4, which is the lower side of the drinking spout 13. Further, the baby's upper lip as indicated in FIG. 1, can touch the liquid food located in the same location as the theoretical line LA1 of FIG. 4, since the top of the guide means 14 is the opening 14*c;* the baby makes movements such as pushing both lips forward in this situation.

In this way, cheek muscles, pushing the lips to forward, are moving forward by pulling on the mouth, so the baby can make these movements, such as pulling the cheeks into the mouth. In this situation, the cheeks will be tightly pressed to the outside of the gums. In this way, the gap between the gums, referred to as the front of the mouth, and the cheeks, and the gap between the gums and the lips are being closed, so the liquid can enter into the mouth easily. These kinds of movements will give babies, during the stage of taking liquid food, an important lesson in the learning process of feeding of liquids.

In other words, babies will learn, through these mouth movements described above, how to gain information on the existence of and the position of liquid food from the feeling in his/her upper lip.

The mother will repeat the above actions, such as inclining the main container 12 smoothly when inserting the liquid food, for all of the contents held, continuously into baby's mouth. At this time, the baby can learn information regarding liquid movement and flow amount through the movement of the liquid surface.

In this way, a baby can start drinking liquid smoothly while taking a small amount of liquid food into the mouth in tandem with breath, swallowing in gulps.

Also, at this time, since the front tip 14*b* of the guide means 14 is formed as a rounded part that is fitted with a curvature that is almost the same as the round part of the drinking cup, the baby can learn the feeling when the lips touch a drinking cup. Further, since the width W1 of the guide means 14 is established in the range described above, it responds to the natural movements baby's lips during these ages, and it can be inserted into the mouth appropriately as well, and no unnecessary gap is formed. In this way, the baby can take liquid without spilling.

Next, after the first step described above is completed and the baby is able to take liquid food completely through the drinking spout member 11, then the drinking spout member 11 of the drinking cup 10 for learning is removed, and training is shifted to the second step of giving liquid food directly from the main container 12.

In the second stage of training, the mother will touch the round part of the opening 12*a* of the cup form of the main container 12 to the baby's mouth, and the baby learns to grip the round part of the opening 12*a* with the upper and lower lips.

In this situation, when the mother inclines the main container 12 gradually, the baby can perceive the feeling of the liquid flow in contact with the upper lip and the baby can lead the liquid food into the mouth by opening the mouth in response his/her amount of preferred intake. At this time, since baby has already learned to perceive the feeling of liquid flow with the upper lip, the baby can drink a fixed amount of liquid food when it enters the mouth and the baby can learn to drink liquid food continuously when it enters the mouth continuously. In this way, the mother can shift to the second stage of training -taking liquid from a container equivalent to an ordinary drinking cup.

Figure 5:
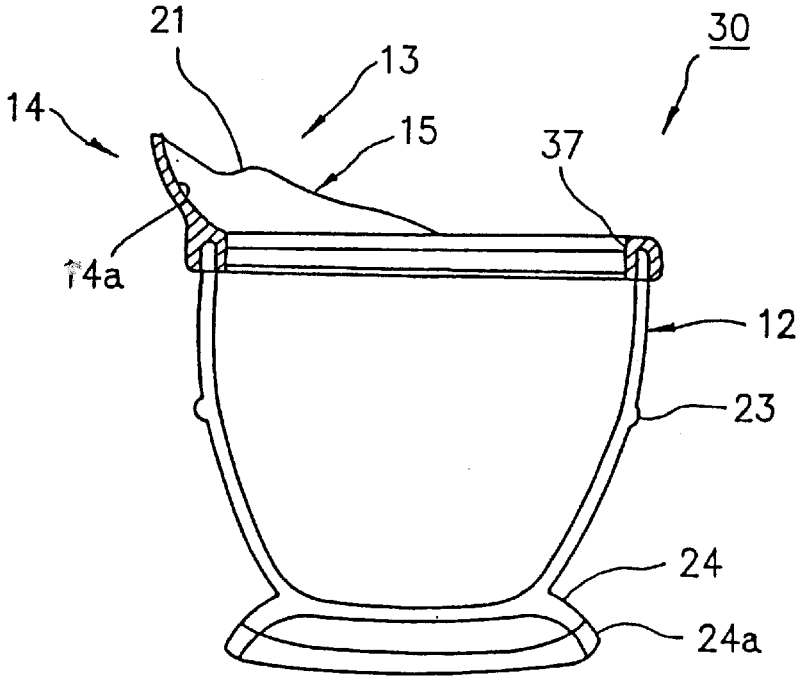
FIG. 5 is a schematic cross-sectional view showing the second embodiment of the drinking cup for learning according to the present invention.

FIG. 5 is a schematic section of the 2nd embodiment of this invention. In this figure, the labeled positions are the same as in the 1st embodiment, which is common to the structure described above. Therefore, we will omit explanations of these elements and the explanation will focus on the differences.

In this figure, the drinking cup 30 for learning, the composition of this main container is exactly the same as the 1st embodiment, but the upper face of the drinking spout member 11 is different.

In this case, the drinking spout member 11 is formed as a ring shape along the round line of the main container 12, and the drinking spout 13 is established in part of the round line of this shape.

In other words, the barrier part 15 of the drinking spout 13 is formed as one piece with the outer circumference-ring of the drinking spout member 11.

The construction of this drinking spout 13 and the guide means 14 are the same as in the 1st embodiment, but in the case of this 2nd embodiment, the drinking spout member 11 is a ring style, and the size of the opening 37 is almost as large as the inner diameter of the main container 12.

At the time of use, when the main container 12 is inclined, the opening 37 cannot limit the flow amount of the liquid food, and the person who uses it must control the flow amount by himself by means such as adjusting the amount with the amount of tilt of the main container 12; however, the function, other than in this point, is as effective as the 1st embodiment.

Figure 6:
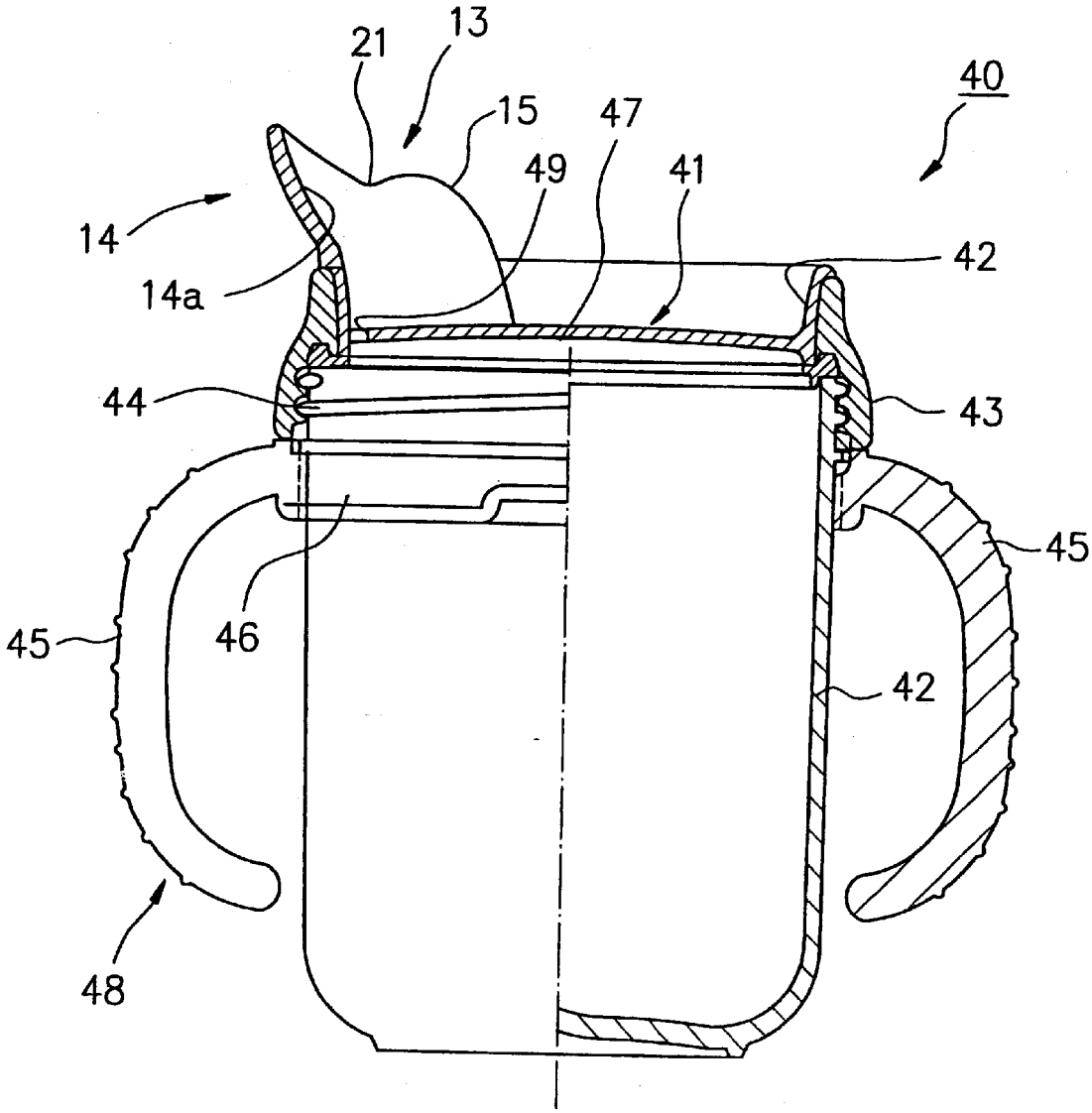
FIG. 6 is a schematic cross-sectional view showing the third embodiment of the drinking cup for learning according to the present invention.

FIG. 6 is a schematic partial section of the 3rd embodiment of this invention.

In this figure, the labeled positions are the same as in the 1st embodiment, which is common to the structure described above, so we will omit duplicate explanations focus on the differences.

This drinking cup for learning 40 is equipped with a main container 42 that has a deeper form than the embodiment described above. This main container 42 is equipped with a screw part 44 around the upper tip mouth as a means of fitting and removing other parts commonly used for babies at different stages of development.

Cover part 43 is fitted to this screw part 44. This cover part 43 is formed in ring style in whole, since it is fitted to the upper rim of the main container, is the unit that is able to cover the opening round edge part of the main container 42, is able to add different shapes in response to other uses, and can be used to improve its appearance. In this embodiment, the cover part 43 is formed as a rounded edge section, in shape the same as an ordinary drinking cup.

The drinking spout member 41, is formed as a removable unit, and can be attached to the inner side of this cover part 43.

The drinking spout member 41 is equipped with a side wall section 42, the circumference of which is formed as either a flange-shape or a ring-shape. The center area is the cover section 47, which is one piece with the side wall section 42, and with this cover section 47, the upper tip of the main container 42 is almost covered.

The drinking spout 13 is formed in the part of the round area of the side wall section 42 mentioned above in the drinking spout section 41. This drinking spout 13 is composed in the same way as the 1st embodiment. Also, the part of the cover section 47 is formed with a small opening section 49 which is connected, and through this drinking mouth 13, the liquid food contained in the main container 42 can be introduced to the drinking spout 13 through this opening section 49.

Accordingly, in this embodiment, since the drinking spout section 41 can be attached to the main container 42 having a deeper cup shape, it is able to compose the cup for learning 40 which can be as effective as any of the forms of mentioned above.

In this way, a screw section is formed in the lower section of the inner wall of the ring shape of the cover section 43, and fitting and removal is possible by matching the circumference of the screw section 44 with the main container 42 mentioned above.

Also, the ring shaped support section 46, which is fitted to the upper circumference of the main container 42, and two hand-grip handles 45, which are extended in one piece from the support section 46, are provided in this cup for learning 40.

These hand-grip handles step 48, for example, are fastened in the area shown in the figure, by the stopper device, not shown, which passes through from the open side of the main container.

In this way, by optional fitting of the removable handgrip device 49 to the main container 42, the baby can learn the drinking movements of the first and second stages described above on his/her own.

Further, in the embodiment shown in the figure, the position of the drinking spout 13 and the position of the handgrip 45 have been shifted 90 degrees to its circumference direction when viewed from the top of the main container 42. This is shown for convenience of understanding the composition of the handgrip device 46.

This embodiment is composed as explained above, and can be used as an ordinary drinking cup by attaching the cover section 43 to the circumference of the upper edge of the main container 42. It can also be used as a cup for first stage training in drinking movement described above, by attaching the drinking spout member 41. Accordingly, with this embodiment, the functions are as effective as the 1st embodiment described above and it can also be used for various purposes by conveniently exchanging the several removable cover sections.

Figure 7:
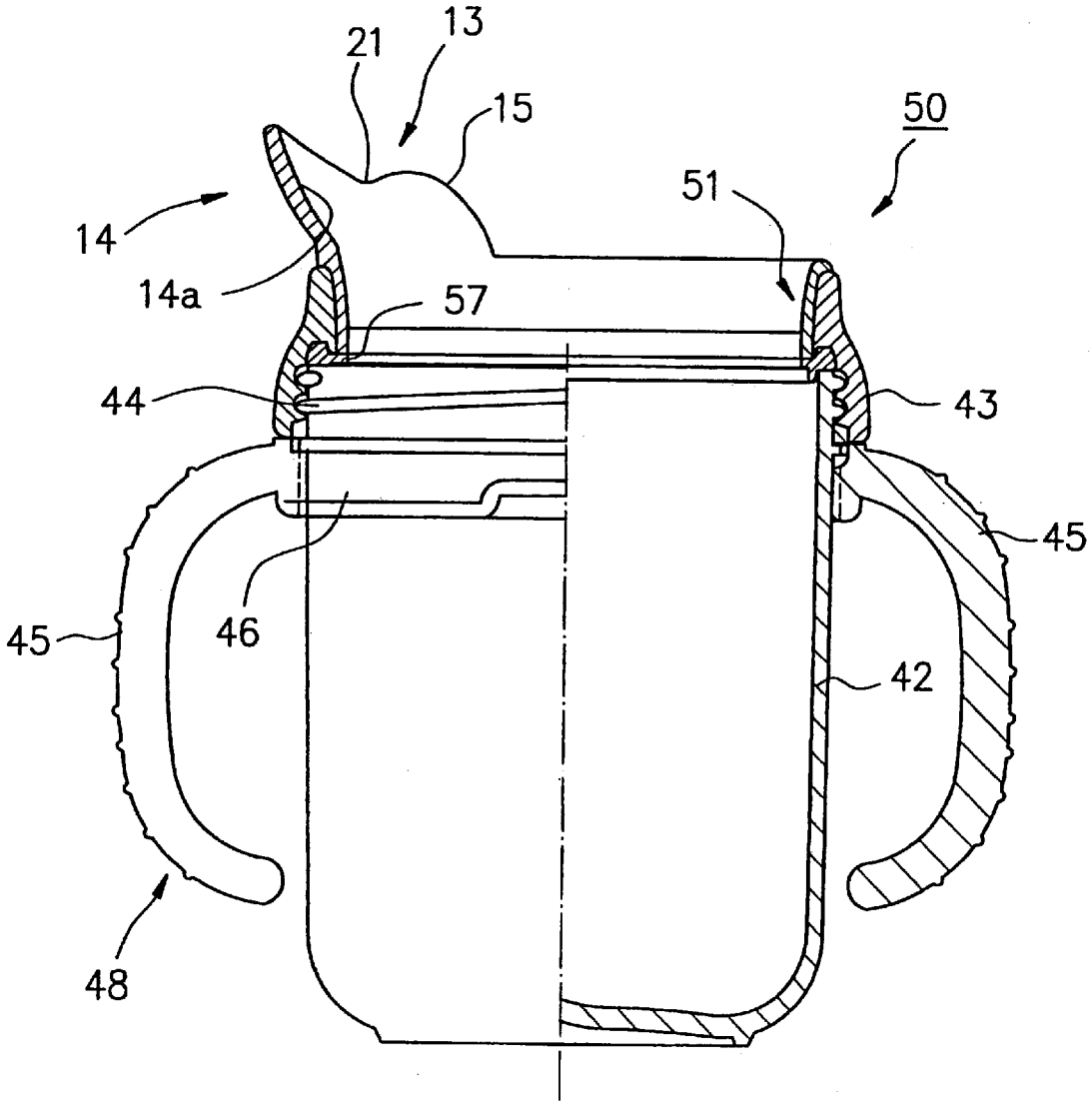
FIG. 7 is a schematic cross-sectional view showing the fourth embodiment of the drinking cup for learning according to the present invention.

FIG. 7 shows the 4th embodiment of this invention.

In this figure, the labeled positions are the same as FIG. 1 and FIG. 6, which are common to the structure, and therefore, we will omit the explanation for these elements and will focus on the differences.

The cup for learning 50 in FIG. 7 is composed in almost the same way as the cup for learning 40, as shown in FIG. 6, and differs only in the drinking spout member.

In the case of the 4th embodiment, the drinking spout section 51 is a ring style, and its open mouth section 57 is almost as big as the inner diameter of the main container 42.

And, at the time of use, when the main container 42 is tilted, the opening section 57 cannot limit the flow amount of the liquid food, so the person who uses it must control the flow amount by himself using means such as adjusting the amount by tilting the main container 42; however the functions, besides this point, are as effective as the 3rd embodiment.

Figure 8:
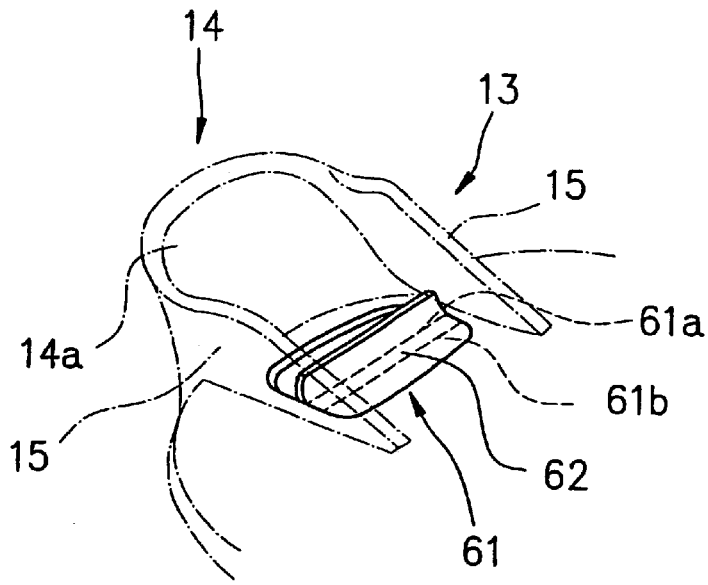
FIG. 8 is a schematic cross-sectional view showing a modification of the mouth part which can be applied to each embodiment of the drinking cup for learning according to the present invention.

FIG. 8 shows the modification of the opening section which is connected to the drinking spout 13, as applied to each of the forms of embodiment described above.

In this figure, the opening 61 corresponds to the opening section 17 in FIG. 1, and this opening 61 is equipped with an adjustable lid 62, made for example of flexible resin material, and is shown partially closed.

The adjustment device, which is originally composed of several notches or stitches 61*a* and 61*b*, forms an adjustable lid 62. The user, cutting off these cutting lines 61*a* and 61*b*, can modify the opening area of the opening section 61.

Therefore, in this modified example, since the area of the open mouth of the opening section 61 can be revised conveniently, the user can determine the appropriate flow amount in response to the stage of the baby's growth.

Figure 9:
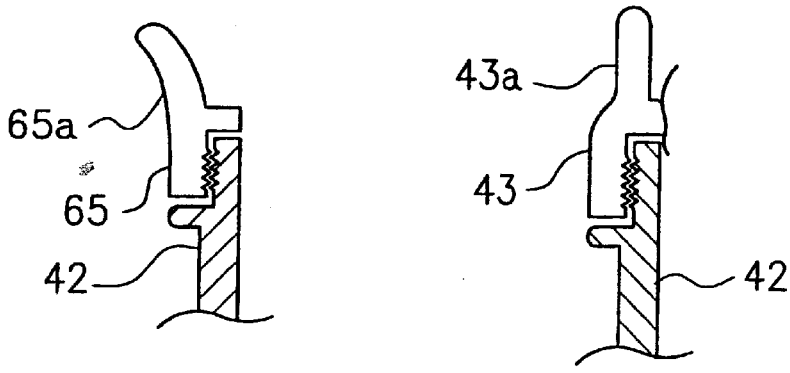
FIG. 9 is a partially-enlarged end view showing an embodiment of the cover part which can be applied to each embodiment of the drinking cup for learning according to the present invention.

FIG. 9 is a partially enlarged end view, to explain the appropriate form of the cover part as explained in FIG. 6 and FIG. 7.

The rounded edge part 43*a* of the ring shaped cover section 43, as shown in FIG. 9(*b*), rises almost vertically, higher than the opening 42.

In comparison with this structure, in the cover part 65, shown in FIG. 9(*a*), its rounded edge section 65*a* is bent outside and forward in the upper direction.

In the embodiment shown in FIG. 6 and FIG. 7, since the cover part 43, if formed as shown in FIG. 9(*b*) specifically, it can prevent the inner diameter of the open mouth, which is formed by the circumference section of its cover section 43, from becoming unnecessarily wider. In this way, when the baby puts his/her mouth on it, the baby does not have to push out his/her lower lip unnecessarily because the circumference round shape cannot possibly become wider. In this way, the baby can take liquid food without changing the shape of his/her mouth. In this way, it is effective for the baby, whose mouth is small, and particularly at the early stages of development when the mouth opening is small, to catch the round section easily.

Figure 10:
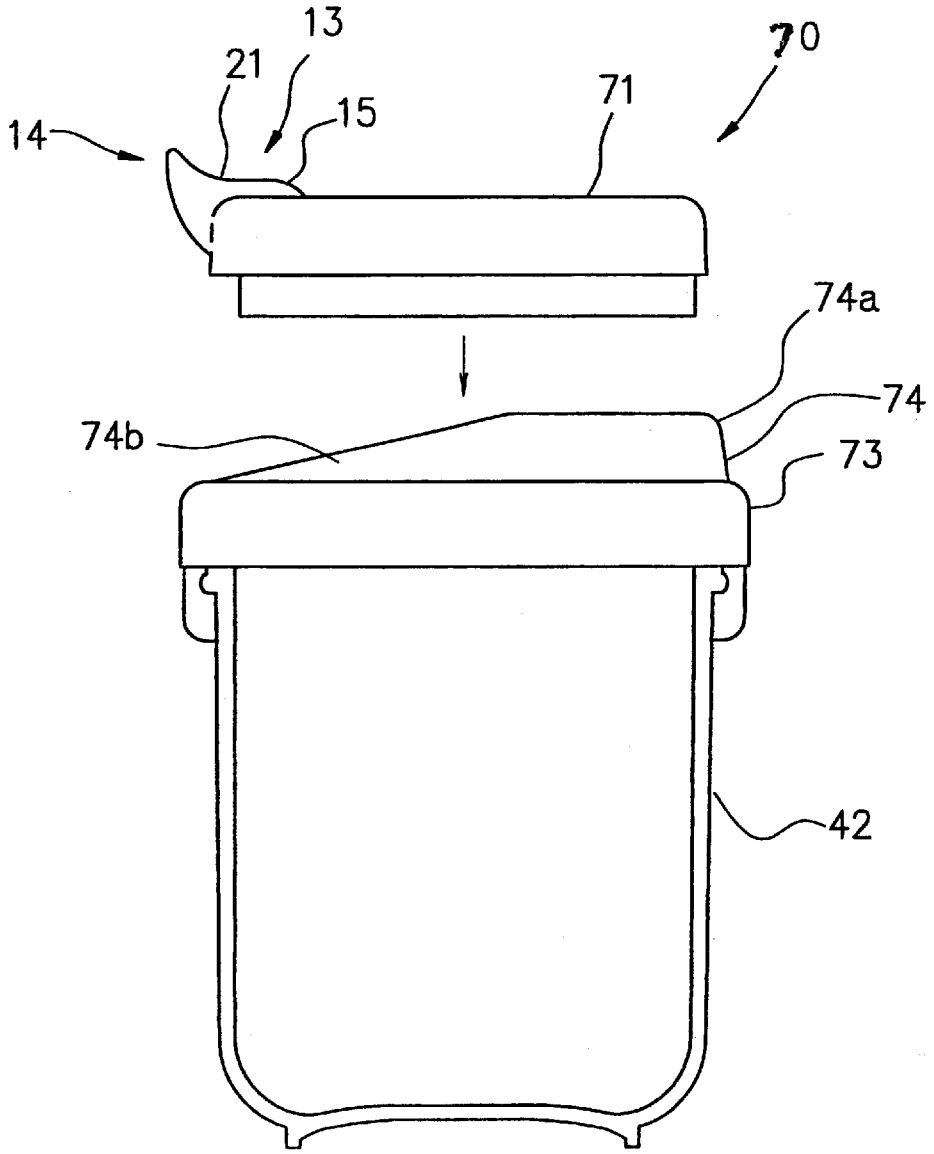
FIG. 10 is a schematic side view showing the fifth embodiment of the drinking cup for learning according to the present invention.

FIG. 10 is a schematic partial section showing the 5th embodiment of the invention.

In this figure, the labeled positions are the same as FIG. 5 and FIG. 7, which are common to the composition; therefore, we will omit the explanation for these compositions and will focus on the differences.

In the drinking cup for learning 70 shown in FIG. 10, a drinking spout member 71 is used, which is formed in a ring shape, and is equipped with the drinking spout 13 in a specified location on the rim.

The removable cover part 73 can be fitted to the upper rim section of the main container 42. The outer diameter of the drinking spout member 71 is made smaller than the inner diameter of the cover part 73, so the drinking spout member 71 can be fitted to and removed from the inner side of the cover part 73.

The cover part 73 of the rim section 74 is equipped with a high side wall part 74*a* and a low side wall part 74*b*. In other words, in the ring shaped cover section 73, the height of the side walls of the round section 74 is modified depending on the area of the rim side.

To this form, in the drinking spout member 71, in the area that forms the drinking spout 13, the guide means 14 protrudes, especially in the upper direction. Accordingly, as shown in the figure, the area of the drinking spout 13 of the drinking spout member 71 will be fitted corresponding to the lower rim side 74*b* of the cover part 73, as shown by the arrow.

In this way, during first stage training in drinking movements, using the cup in the state having the cover section 73 and the drinking spout section 71 connected, because the guide means 14 of the drinking spout 13 is not protruding extremely higher than the rim part 74, it is easy to have the appropriate height for drinking liquid.

In the event the drinking spout section 71 is removed and the baby's mouth holds the rim part 74 of the cover section 73, it is more effective for the baby to drink if the baby holds the higher area 74*a*, because the rim section 74*b* on other side becomes relatively lower, and it will not as easily touch the baby's face when the main container 42 is tilted.

Figure 11:
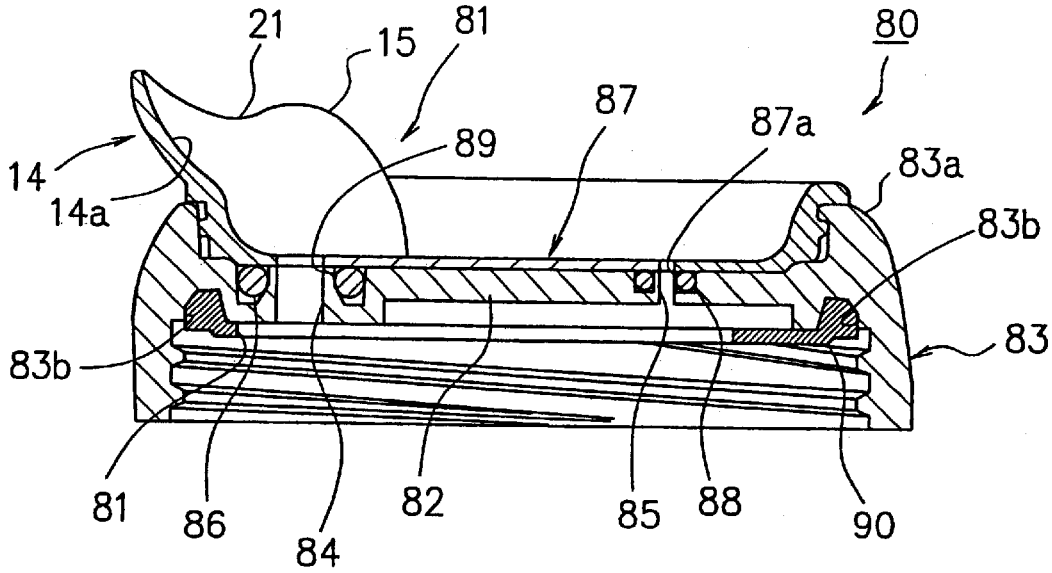
FIG. 11 is a schematic partial cross-sectional view showing the sixth embodiment of the drinking cup for learning according to the present invention.
Figure 12:
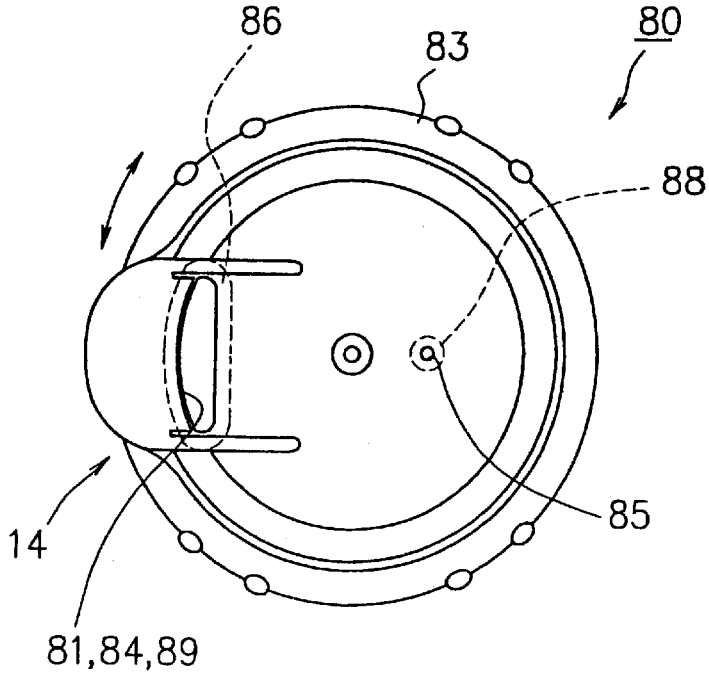
FIG. 12 is a schematic plan view showing the drinking cup for learning shown in FIG. 11.
Figure 16:
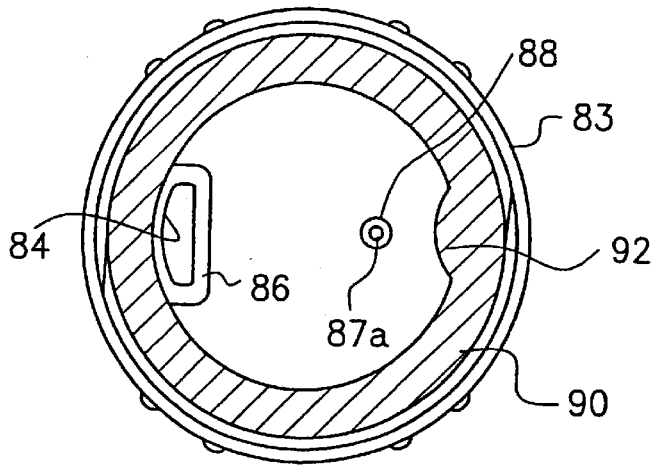
FIG. 16 is a schematic bottom view of the shape, excluding the main container, of the drinking cup for learning shown in FIG. 11.

FIG. 11 is a schematic partial section showing the 6th embodiment of this invention. FIG. 12 is a plan view of FIG. 11 and FIG. 16 is the base view of FIG. 11.

In these figures, the labeled positions are the same as FIG. 1 and FIG. 10, which are common to the composition; therefore, we will omit the explanations of these elements and will focus on the differences.

The main container of the drinking cup for learning 80 in FIG. 11 is the same as shown in FIG. 6 for example, so we will omit the explanation about the main container. In this drinking cup for learning 80, the drinking spout section is not established independently, as in the forms of embodiment mentioned above. In this form, the drinking spout section is formed as part of the drinking mouth section 81 on the lid unit 87.

In this drinking cup for learning 80, the upper edge of the cover section 83, a removable cover on the upper rim of the main container, is closed as the closed part 82. Also, the cover section 83 is equipped with the circular enclosure, looked at from the top (refer to FIG. 12), having the fixed inner diameter of the ring shape rim section 83*a* of the closing section 82 mentioned above. And, the cover part 83 is equipped with a first open mouth 84, relatively big and formed in the area closer to the round section, and a second open mouth 85, smaller than the first open mouth 84.

In this cover part 84, the lid body 87 is provided. This lid body is established with the circle enclosure when looked at it from the top (refer to FIG. 12), and the upper side is closed. The outer diameter of the lid 87 is slightly smaller than the outer diameter of the ring shaped rim section 83*a* of the cover part 83 and is formed from materials that are slightly flexible. In this way, the lid 87, as shown in FIG. 11, is made to be able to circle around in the direction of the rim, as shown in FIG. 12, inside the ring shaped rim part 83*a* of the cover part 83. Also, the ring shaped packing 86 and 88, which is given the seal functions, are attached to each outer circumference of the first open mouth 84 of the cover part 83, and to the second open mouth 85 which is smaller.

The lid 87 is equipped with the relatively large first open mouth 89, which is formed in the area near the circumference, and the second open mouth 87*a*, which is smaller than the first open mouth 89. And, as described above, the drinking spout section 81 is formed in the part closer to the outer circumference of the lid 87. The composition of this drinking spout section 81 are the same as the drinking spout member, for example, the drinking spout member 11 of FIG. 1, are labeled accordingly.

Also, the seal member 90, which is positioned on the upper edge (not drawn) between the cover section 83 and the main container, is attached to the main container side of the cover section 83; in other words, in the lower face in FIG. 11.

Figure 14:
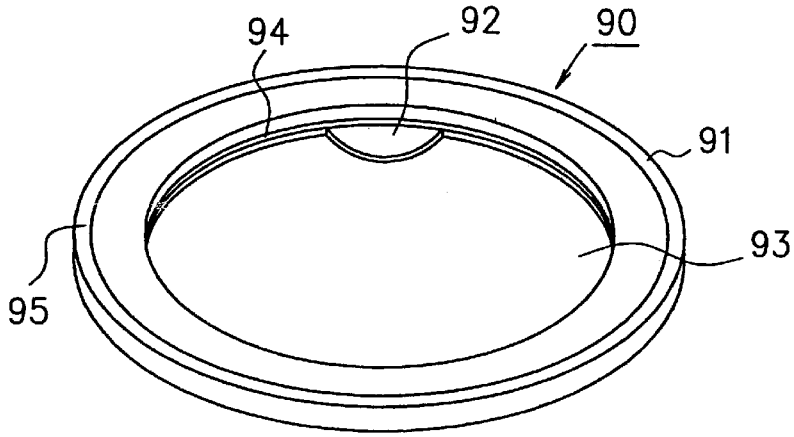
FIG. 14 is a schematic perspective view showing the seal part of the drinking cup for learning shown in FIG. 11.
Figure 15:
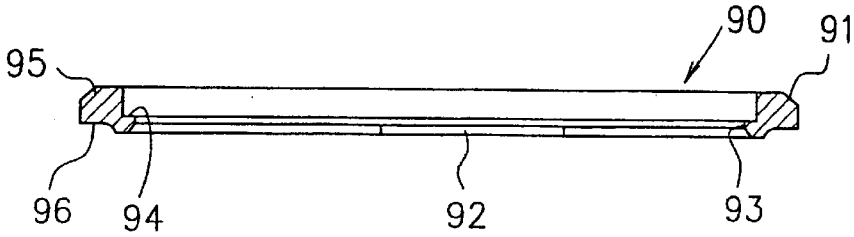
FIG. 15 is a schematic cross-sectional view showing the seal part shown in FIG. 14.

As the 1st embodiment of this seal member 90, its perspective view is shown in FIG. 14 and its outline section view is shown in FIG. 15. The seal member 90, for example, is composed of strong materials that are relatively pliable and flexible, for example silicone or elastomer, and is the narrow ring shaped section given in the open mouth 93 as shown in FIG. 14.

The ring shaped main body 91 of this seal member 90 is the inserting section, which would be inserted in hole 83*b* of the cover section 83 as described below. The projecting or the salient side 82, which is pushed inward, is formed in the inner side of the main body 91. The ring shaped main body 91 has a fixed thickness rearward and is formed to be inserted into the circler hole 83*b* that is formed in the lower edge of the cover section 83. In this case, the main body 9 is as shown in FIG. 15, and the inclining face 95, which becomes gradually lower in the outward direction, is formed in the upper edge of its circumference. In this way, the inclining face 95 will function as the guide means, so it can be easily inserted into the hole 83*a* of the cover section 83. Also, the lower side 96 of the main body 91 is formed in a flat face, so, it can be attached to the upper edge of the main container. Further, the projected step part 95, which protrudes slightly in the inward direction, is fitted in this main body 91, as shown in FIG. 11. It is composed to be able to connect along the lower edge of the inner side of the hole section of the cover section 83.

Since the seal member 90 is equipped with these components, as shown in FIG. 16, it is easily fitted to and removed from to the cover section 83 with the projected side 92, which is protrudes to the lower side of the cover section 83, as a tab.

The $6^{th}$ embodiment of the drinking cup for learning is composed as above. The liquid food contents in the main container will be led outside, passing through the big open mouth 93 of the seal member 90, the first open mouth 84 of the cover section 83 and the first open mouth 98 of the lid body 87. In this case, the movement of the drinking spout section 14 of the lid body 87 is the same as the movement of the drinking mouth section in the 1st embodiment. Therefore, by using this drinking cup for learning 80, it is possible to train in drinking movements step-by-step, in order to give the baby, who is at the age of taking milk and taking liquid foods, lessons in the technique for taking either liquids or the liquid food naturally, without spilling them.

Further, as shown in FIG. 11 and FIG. 12, when the first open mouth 84 of the cover section and the first open mouth 89 of the lid body 87 are connected in the same position around the circumference, because the big open mouth 93 of the seal member 90, the first open mouth 84 of the cover section 83 and the first open mouth 89 of the lid body 87 can all be passed through, it is possible to lead the liquid food, contained in the main container, to the outside.

Figure 13:
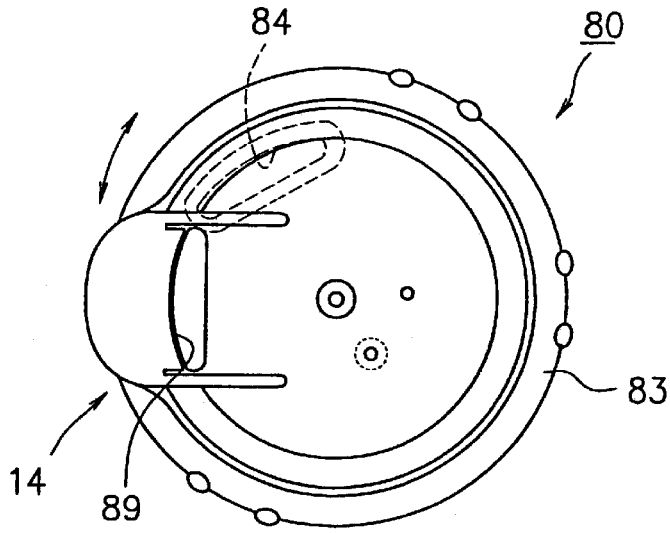
FIG. 13 is a schematic plan view showing the drinking cup for learning shown in FIG. 11.

To this form, as shown in FIG. 13, if the lid body 87 is turned in the inner circumference of the cover section 83, the area of the first open mouth 84 of the cover section 83 and the first mouth 89 of the lid body 87 will be open in the direction of the circumference. In this way, since the two open mouths 84 and 87 will be closed completely by the packing 86 and the packing 88, spilling of liquid food can be prevented.

Therefore, in this drinking cup for learning 80, by the simple turning operation of the lid unit 87 only, it will achieve the function of the easy locking in order to prevent liquid from the leaking outside the main container.

Figure 17:
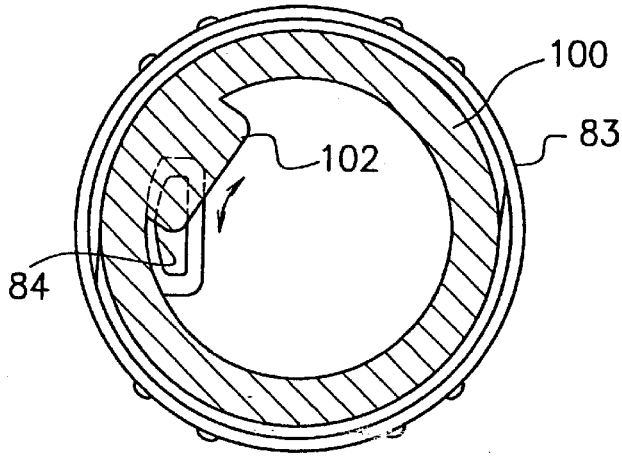
FIG. 17 is an explanatory view of the first modification of the seal of the drinking cup for learning shown in FIG. 11.
Figure 20:
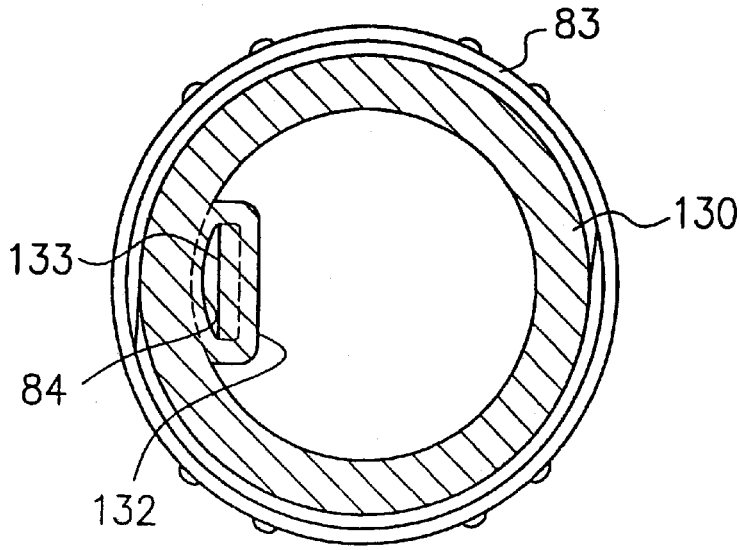
FIG. 20 is an explanatory view of the fourth modification of the seal of the drinking cup for learning shown in FIG. 11.

FIG. 17 and FIG. 20 show the modification of the seal member which is attached to the cover section 83.

FIG. 17 shows the 1st modified example of the seal member. In this figure, the seal member 100 is the same as the labeled section explained in FIGS. 14 and 15, except the form of the protrusion side, and we will omit the explanation in regard to these composition, and will focus on the differences.

FIG. 17 is an outline figure that looks at the state wherein the seal member 100 is attached to the cover section 83, looked at from the lower side. In this figure, the protrusion side 102 of the seal member 100 is given a larger form and a wider area compared with the protrusion side 92 of the seal member 90 mentioned above.

In other words, the comparatively larger area, the protrusion side 102 with a rectangular shape, is formed in the inner direction from its inner circumference section in the seal member 110. Therefore, when this seal member 100 covers up to the cover section 83, the size of the area for the protruding side 102 to pass through the first open mouth 84 of the cover section 83 can be adjusted by modifying the area in the direction of the circumference as shown by the arrow.

In this way, it is possible to control the flow amount of the liquid food in the main container by modifying the area, in the circumference direction of the seal member 100 to be fitted.

Figure 18:
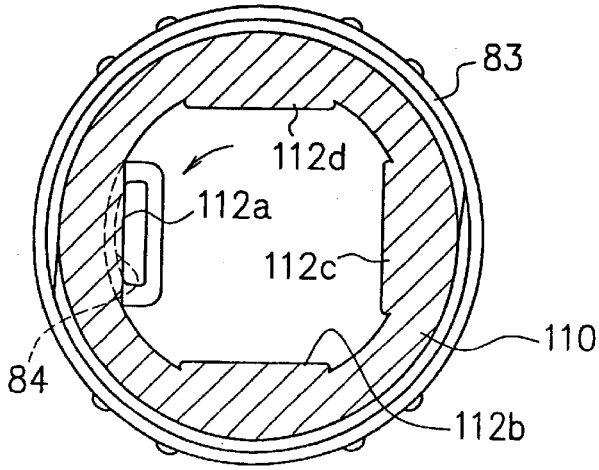
FIG. 18 is an explanatory view of the second modification of the seal of the drinking cup for learning shown in FIG. 11.

FIG. 18 shows the 2nd modified pattern of the seal member. In this figure, the seal member 100 is the same as the labeled parts explained in FIGS. 14 and 15, except for the shape of the protruding side; so we will omit the explanation in regard to these elements, and will focus on the differences.

In the seal member 110 of FIG. 18, the four protruding sides 112*a,* 112*b,* 112*c,* and 112*d,* which are smaller areas than the protruding side 102 of the seal member 100 of FIG. 17, for example, each of them formed in slightly different shapes, are formed from the inner circumference section inward from the seal member 110. Therefore, in the case this seal member 110 is fitted to the cover section 83, by changing the area to the circumference direction, shown by the arrow, in each ¼ turn, each protruding side 112*a,* 112*b,* 112*c,* and 112*d* can be selected and can be united with the first open mouth 84 of the cover section 83. In this way, the first open mouth 84 of the cover section 83 can be closed completely. Selection from protruding sides 112*a,* 112*b,* 112*c,* and 112*d* can be made, in order in correspond to the baby's growth, and by attaching it to the area of the first open mouth 83 of the cover section 83, it can control amount of liquid food provided to the baby from the main container, in response to the stage of the baby's growth.

Figure 19:
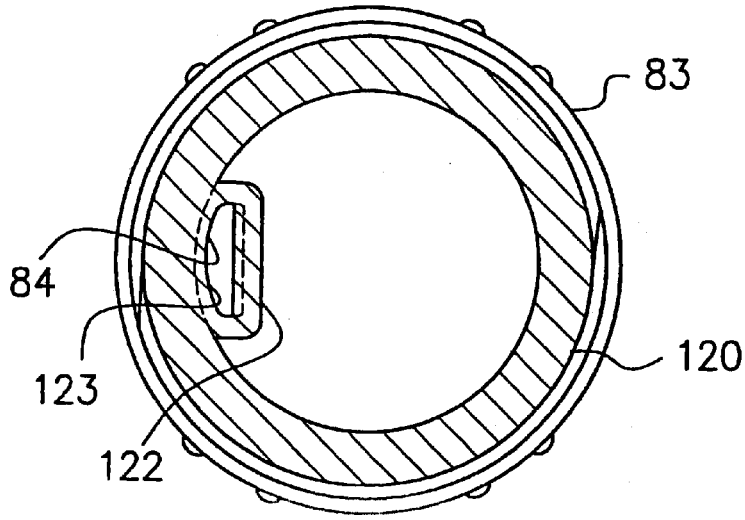
FIG. 19 is an explanatory view of the third modification of the seal of the drinking cup for learning shown in FIG. 11.

FIG. 19 shows the 3rd modification of the seal member. In this figure, the seal member 120 has the same components as the seal member explained in FIGS. 14 and 15, except the form of the protruding side, and we will omit the explanation in regard to these elements; focusing on the differences.

In other words, the comparatively larger area of the rectangular protruding side 122, is formed inward from its inner circumference section in the seal member 120, and the open mouth 123 is formed in the center of its part. The area of this open mouth 123 is established as smaller than the area of the first open mouth 84 of the cover section 83. Therefore, the area which is connected with the main container and the first open mouth 84 of the cover section 83 can be decreased by matching the protruding side 122 of the seal member 120 to the area, to the first open mouth 84 of the cover section 83 and by attaching the seal member 120 to the cover section 83.

Further, in this area, as shown in the figure, it is structured to be matched with the outside circumference of the open mouth 123 and the outside circumference of the first open mouth 84 of the cover section 83.

In this way, when the open mouth 84 and the open mouth 123 are adjusted to different areas, the amount of liquid food which is led from the main container to the outside cannot be controlled in the open mouth 123. Also, in the event that the open mouth 84 and the open mouth 123 are adjusted in a single area, the amount of flow of the liquid food is controlled in the open mouth area of the open mouth 123 and its amount can be decreased more than the amount in the area in which the protruding side 122 was adjusted in the another area. Therefore, in this embodiment, the flow amount of the liquid food can be controlled by two steps.

Further, as described above, the circumference of the outside of the first open mouth 84 of the cover 83 is designed to unite with the circumference of the outside of the open mouth 84. In this way, when the main container is tilted, since the liquid will not be stopped temporarily in the outside area of the open mouth 123, preventing the situation in which the liquid flows at one time by exceeding the outside of the open mouth 123 is possible. In this point, there is an advantage in comparison with the case of the structure in FIG. 18.

FIG. 20 shows the 4th modification of the seal member. In this figure, the seal member 130 has the same components as the seal member explained in FIGS. 14 and 15, except the shape of the protruding side, and we will omit the explanation in regard to these elements, focusing on the differences.

In this figure, the different point of the protruding 132 of the seal member 130 is that its open mouth 133 at the center is made smaller than the open mouth 123 of the protruding side of 122 in comparison with the protruding side 122 of the seal member 120 described above.

Therefore, in this case, one can decrease the flow amount of the liquid food, so it is suitable for a baby who is in the earlier stages of growth.

In other words, in the embodiment mentioned above, according to the growth stages of the baby, for example, a method of use to increase the flow amount of the liquid food at a particular time can be considered, using each seal member of FIG. 20, FIG. 19 and FIG. 16 in order.

As in the explanation above, according to the present invention, a drinking cup for learning includes:

a main container for containing liquid, the main container having at least a cup-shaped opening; and a drinking spout member removably attached to said main container, wherein the drinking spout member includes an opening communicating with the main container and a top-opened guide means provided with barrier portions forming at least both side edges.

With this structure, the liquid food contents in the main container will leave the container. When the cover and the drinking spout member are attached to the main container, the liquid food can be introduced appropriately into the baby's mouth through the opening of the drinking spout member.

By inclining the main container, the liquid food can be led to the guide means through the opening of the drinking spout member. With the barrier portions forming two side edges, the liquid food will not be spilled. At this time, since the upper side of the guide means is open, the baby's upper lip can touch the liquid food. In this way, the baby can be trained to perceive the flow of the liquid food through feeling.

Also, throughout this training, when the baby learns to be able to perceive the flow of the liquid through his/her upper lip to some degree, the training can be shifted to taking liquid from an ordinary cup by removing the drinking spout member, and by adding the cup-shaped opening of the cover.

Also, in this invention, the periphery of the cover may be composed of a upwardly protruded projection.

In this case, since the periphery of the cover is standing up almost vertical, the cover can have an area of the opening close to the diameter of the periphery of the main container, and the opening will get larger as necessary, so babies easily can touch it to their mouth.

Also, according to another aspect of the present invention, a drinking cup for learning, including:

a main container for containing liquid;

a cover removably fitted to a periphery of the main container such that the cover closes an upper portion of the main container, the cover having an opening communicating with the main container; and a lid rotatably attached to the cover, wherein the lid is provided with a drinking spout portion having a top-opened guide means at a portion corresponding to the opening, the guide means including a barrier portion forming at least both side edges, whereby liquid contained in the main container is introduced into the drinking spout portion when the opening of the lid is communicated with the opening of the cover.

With this structure, the liquid food contents in the main container, which is equipped with a cup-shaped opening, will pass trough the opening of the cover, pass through the opening of the lid, and go to the outside, and pass through the drinking spout member of the lid, and the liquid food can be introduced appropriately into the baby's mouth through the opening of the drinking spout member.

By tilting the main container, the liquid food can be led to the guide means through the opening of the drinking spout member. Thanks to the barrier portion forming two side edges, the liquid food will not be spilled. At this time, since the upper side of the guide means is open, the baby's upper lip can touch the liquid food. In this way, the baby can be trained to perceive the flow of the liquid food through feeling.

In this invention, the seal member disposed between the cover and the main container may be detachably attached to the cover.

With this construction, it is possible to wash and exchange parts by removing the seal member from the cover.

In this invention, possible construction may be created with the protrusion used in conjunction with an opening smaller than the opening equipped in the lid.

With this construction, since the size of the protrusion is smaller than that of the opening provided in the lid, it is possible to restrict the flow of the liquid food which comes from the main container.

This invention shall not be limited to the embodiment described above. For instance, putting color or the marks on it can also give the locator position. Also, the partial construction of the aforementioned embodiments may be combined arbitrarily.

As described above, in the present invention, we can provide a drinking cup for learning which is able to provide training in drinking movements, step-by-step, in order to provide a baby, who is at the stage of taking milk and taking liquid foods, the lessons in the technique for taking either liquids or the liquid food naturally without spilling them.

POSSIBILITIES FOR INDUSTRIAL USE

As described above, this invention can be used for a drinking cup for learning in order to train babies in taking liquids, including beverages or liquid foods.

What is claimed is:

1. A drinking cup for learning, comprising:

a main container for containing liquid, said main container having at least a cup-shaped opening; and a drinking spout member with an outer circumferential surface removably attached to said main container, wherein said drinking spout member includes an opening communicating with said main container and a top-opened guide structure provided with a plurality of linear barrier portions;

wherein a portion of said top-opened guide structure protrudes said outer circumferential surface of the drinking spout member;

wherein said top-opened guide structure has an inclining face with a concave part is provided between the plurality of linear barrier portions;

wherein the end part of the main container side of the said concave part, and the end part of the front-end side of said concave part are higher.

2. The drinking cup for learning as recited in claim 1, wherein said guide means is provided with a changing means for changing an area of said opening in a plurality of predetermined steps.

3. The drinking cup for learning as recited in claim 1, wherein the width between the plurality of linear barrier portions is within a range from 25 mm to 40 mm.

* * * * *